US006681862B2

(12) United States Patent
Freeman

(10) Patent No.: US 6,681,862 B2
(45) Date of Patent: Jan. 27, 2004

(54) SYSTEM AND METHOD FOR REDUCING THE PRESSURE DROP IN FLUIDS PRODUCED THROUGH PRODUCTION TUBING

(75) Inventor: Tommie Austin Freeman, Flower Mound, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 10/059,867

(22) Filed: Jan. 30, 2002

(65) Prior Publication Data

US 2003/0141074 A1 Jul. 31, 2003

(51) Int. Cl.[7] ..... E21B 43/12

(52) U.S. Cl. ..... 166/384; 166/207; 166/313

(58) Field of Search ..... 166/380, 381, 166/384, 313, 50, 207, 206, 212, 217, 250.02

(56) References Cited

U.S. PATENT DOCUMENTS

| | | | | |
|---|---|---|---|---|
| 1,500,829 | A | 7/1924 | Layne | |
| 1,880,218 | A | 10/1932 | Simmons | |
| 3,167,122 | A | 1/1965 | Lang | |
| 3,179,168 | A | 4/1965 | Vincent | |
| 3,203,483 | A | 8/1965 | Vincent | 166/207 |
| 3,270,817 | A | 9/1966 | Papaila | |
| 3,297,092 | A | 1/1967 | Jennings | 166/207 |
| 3,353,599 | A | 11/1967 | Swift | |
| 3,477,506 | A | 11/1969 | Malone | 166/207 |
| 5,014,779 | A | 5/1991 | Meling et al. | 166/55.7 |
| 5,337,823 | A | 8/1994 | Nobileau | 166/227 |
| 5,348,095 | A | 9/1994 | Worrall et al. | 166/380 |
| 5,366,012 | A | 11/1994 | Lohbeck | 166/277 |
| 5,425,559 | A | 6/1995 | Nobileau | 285/330 |
| 5,562,000 | A | 10/1996 | Shultz, Sr. | 72/393 |
| 5,667,011 | A | 9/1997 | Gill et al. | 166/295 |
| 5,901,789 | A | 5/1999 | Donnelly et al. | 166/381 |
| 5,924,745 | A | 7/1999 | Campbell | 285/90 |
| 6,012,523 | A | 1/2000 | Campbell et al. | 166/277 |
| 6,021,850 | A | 2/2000 | Wood et al. | 166/380 |
| 6,029,748 | A | 2/2000 | Forsyth et al. | 166/380 |
| 6,070,671 | A | 6/2000 | Cumming et al. | 166/381 |
| 6,098,717 | A | 8/2000 | Bailey et al. | 166/382 |
| 6,112,818 | A | 9/2000 | Campbell | 166/384 |
| 6,253,850 | B1 | 7/2001 | Nazzai et al. | 166/277 |
| 6,315,040 | B1 | 11/2001 | Donnelly | 166/207 |
| 6,478,091 | B1 * | 11/2002 | Gano | 166/373 |
| 6,491,101 | B2 * | 12/2002 | Ohmer | 166/313 |
| 6,497,289 | B1 * | 12/2002 | Cook et al. | 166/380 |

FOREIGN PATENT DOCUMENTS

| | | | |
|---|---|---|---|
| EP | 0 824 628 B1 | 12/1998 | E21B/17/08 |
| GB | 2 336 383 A | 10/1999 | E21B/43/08 |
| GB | 2 344 606 A | 6/2000 | E21B/33/14 |
| GB | 2 348 223 A | 9/2000 | E21B/7/20 |
| WO | WO 93/25799 | 12/1993 | E21B/43/10 |
| WO | WO 93/25800 | 12/1993 | E21B/13/10 |
| WO | WO 96/22452 | 7/1996 | E21B/43/10 |
| WO | WO 96/37680 | 11/1996 | E21B/17/08 |
| WO | WO 96/37681 | 11/1996 | E21B/17/08 |

(List continued on next page.)

*Primary Examiner*—William Neuder
(74) *Attorney, Agent, or Firm*—Lawrence R. Youst

(57) ABSTRACT

A well completion system for reducing the pressure drop in fluids produced from a downhole formation (14) traversed by a wellbore (32) comprises a production tubing (30) used to bring the formation fluids to the surface that is positioned within a well casing (34) that lines the wellbore (32). An expander member (56) is positioned within the production tubing (30) and travels longitudinally within the production tubing (30) to expand the flow area within the production tubing (30) once the production tubing (30) has been installed downhole, thereby reducing the pressure drop in fluids produced through the production tubing (30).

56 Claims, 7 Drawing Sheets

FOREIGN PATENT DOCUMENTS

| | | | |
|---|---|---|---|
| WO | WO 97/17526 | 5/1997 | E21B/43/10 |
| WO | WO 97/17527 | 5/1997 | E21B/43/10 |
| WO | WO 99/23354 | 5/1999 | E21B/43/10 |
| WO | WO 99/56000 | 11/1999 | E21B/43/10 |
| WO | WO 00/26500 | 5/2000 | E21B/19/22 |
| WO | WO 00/26501 | 5/2000 | E21B/43/10 |
| WO | WO 00/26502 | 5/2000 | E21B/29/10 |
| WO | WO 00/37767 | 6/2000 | E21B/29/00 |
| WO | WO 00/37771 | 6/2000 | E21B/43/10 |
| WO | WO 00/37772 | 6/2000 | E21B/43/10 |
| WO | WO 00/37773 | 6/2000 | E21B/43/10 |
| WO | WO 00/39432 | 7/2000 | E21B/43/10 |
| WO | WO 00/50732 | 8/2000 | E21B/43/10 |
| WO | WO 00/50733 | 8/2000 | E21B/43/10 |
| WO | WO 00/63523 | 10/2000 | E21B/33/127 |
| WO | WO 01/18353 A1 | 3/2001 | E21B/43/10 |
| WO | WO 01/18354 A1 | 3/2001 | E21B/43/10 |
| WO | WO 01/18355 A1 | 3/2001 | E21B/43/10 |
| WO | WO 01/83943 A1 | 11/2001 | E21B/43/10 |

* cited by examiner

SYSTEM AND METHOD FOR REDUCING THE PRESSURE DROP IN FLUIDS PRODUCED THROUGH PRODUCTION TUBING

TECHNICAL FIELD OF THE INVENTION

This invention relates, in general, to completing a well that traverses a hydrocarbon bearing subterranean formation and, in particular, to a system and method for reducing the pressure drop in the fluids produced through a production tubing by expanding the flow area of the production tubing downhole.

BACKGROUND OF THE INVENTION

Without limiting the scope of the present invention, its background will be described with reference to producing fluid from a subterranean formation, as an example.

After drilling each of the sections of a subterranean wellbore, individual lengths of relatively large diameter metal tubulars are typically secured together to form a casing string that is positioned within each section of the wellbore. This casing string is used to increase the integrity of the wellbore by preventing the wall of the hole from caving in. In addition, the casing string prevents movement of fluids from one formation to another formation. Conventionally, each section of the casing string is cemented within the wellbore before the next section of the wellbore is drilled. Accordingly, each subsequent section of the wellbore must have a diameter that is less than the previous section.

For example, a first section of the wellbore may receive a conductor casing string having a 20-inch diameter. The next several sections of the wellbore may receive intermediate casing strings having 16-inch, 13⅜-inch and 9⅝-inch diameters, respectively. The final sections of the wellbore may received production casing strings having 7-inch and 4½-inch diameters, respectively. Each of the casing strings may be hung from a casing head near the surface. Alternatively, some of the casing strings may be in the form of liner strings that extend from near the setting depth of previous section of casing. In this case, the liner string will be suspended from the previous section of casing on a liner hanger.

Once this well construction process is finished, the completion process may begin. The completion process may include numerous steps such as creating hydraulic openings or perforations through the production casing string, the cement and a short distance into the desired formation or formations so that production fluids may enter the interior of the wellbore, formation stimulation to enhance production, gravel packing to prevent sand production and the like. The completion process also includes installing a production tubing string within the well that extends from the surface to the production interval or intervals. Unlike the casing strings that form a part of the wellbore itself, the production tubing string is used to produce the well by providing the conduit for formation fluids to travel from the formation depth to the surface.

The diameter of the production tubing that is installed within a well is determined based upon a number of factors. For example, the maximum diameter of the production tubing is limited by the various restrictions within the well including the production casing and any tools within the production casing such as landing nipples. In addition, the production tubing is sized based upon the reservoir pressure, composition of the formation fluids and the expected production rate from the formation. For example, if the production tubing selected for a well is too large, slugging may occur during production in which case a workover may be required to install smaller production tubing or an artificial lift system. On the other hand, if the production tubing selected for a well is too small, the pressure drop in the formation fluids traveling through the production tubing is unnecessarily large and the rate of production from the formation is unnecessarily constrained, in which case, a workover may be required to install larger production tubing.

A need has therefore arisen for a system and method for completing a well that traverses a subterranean formation that minimize the likelihood of installing a production tubing string that is not properly sized for the production from the traversed formation. A need has also arisen for such a system and method that are capable of reducing the pressure drop in the fluids produced through the production tubing when the formation is capable of producing at a higher rate. Further, a need has arisen for such a system and method that do not require a workover to optimize the size of the production tubing.

SUMMARY OF THE INVENTION

The present invention disclosed herein comprises a system and method for completing a well that traverses a subterranean formation that minimize the likelihood of installing a production tubing string that is not properly sized for the production from the traversed formation. The system and method of the present invention are capable of reducing the pressure drop in the fluids produced through the production tubing when the formation is capable of producing at a higher rate. Further, the system and method of the present invention do not require a workover to optimize the size of the production tubing.

The well completion system of the present invention comprises a production tubing that is positioned within a well casing that lines the wellbore and an expander member positioned within the production tubing that travels longitudinally within the production tubing to expand the production tubing downhole, thereby reducing the pressure drop in fluids produced through the production tubing. The expansion process may proceed from an uphole location to a downhole location or from a downhole location to an uphole location. The force required to expand the production tubing may be generated by pressurizing at least a portion of the production tubing to urge the expander member to travel longitudinally within the production tubing. This fluid pressure may be delivered directly into the production tubing or may be introduced through a coiled tubing that may be coupled to the expander member. Additionally or alternatively, when coiled tubing is used, the coiled tubing may be placed in tension to mechanically urge the expander member to travel longitudinally within the production tubing.

Broadly stated, one method of the present invention comprises the steps of lining the wellbore with a well casing, disposing the production tubing within the well casing and expanding the production tubing downhole, thereby reducing the pressure drop in fluids produced through the production tubing. The expansion step may be independent of or as a result of first testing the productive capability of the formation traversed by the wellbore to determine whether production from the formation is constrained by the production tubing.

Another method of the present invention comprises the steps of lining a first section of the wellbore with a first well casing having an inner diameter, lining a second section of the wellbore with a second well casing having an inner diameter that is smaller than the inner diameter of the first well casing, disposing the production tubing within the first and the second well casings and expanding the production tubing downhole that is disposed within the first well casing.

Yet another method of the present invention comprises the steps of lining at least a main wellbore portion of a multilateral well with a well casing, extending first and second branch wellbores from the main wellbore, the second branch wellbore being farther downhole than the first branch wellbore, disposing a main section of production tubing within the well casing in the main wellbore, a first branch section of production tubing within the first branch wellbore and a second branch section of production tubing within the second branch wellbore and expanding the production tubing downhole that is uphole of the first branch wellbore. In this method, it may be desirable to expand the flow area of the production tubing that is uphole of the first branch wellbore to substantially match the flow area of the first branch section of production tubing and the flow area of the second branch section of production tubing.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
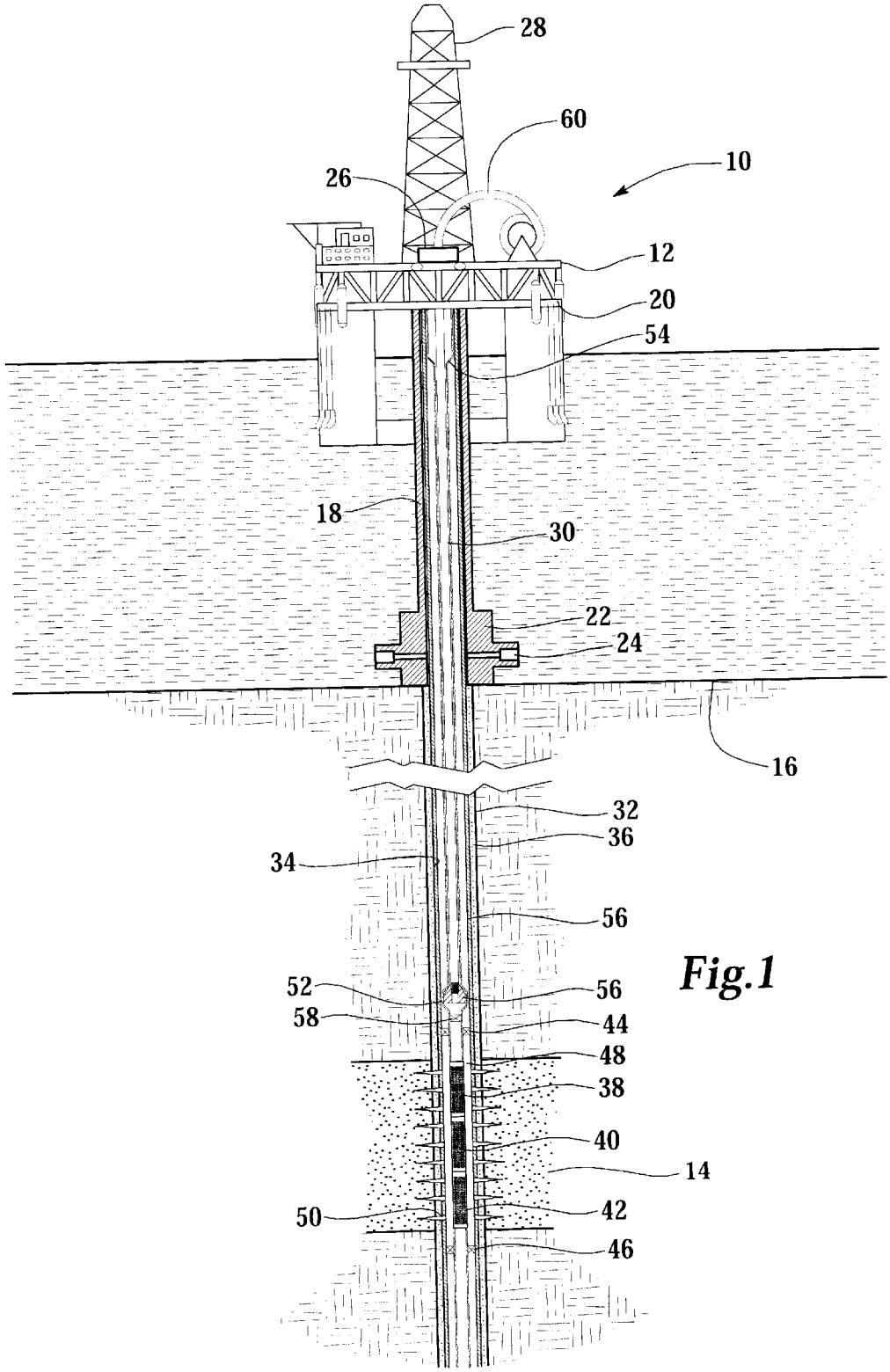
FIG. 1 is a schematic illustration of an offshore oil and gas platform installing an expandable production tubing string according to the present invention.

Referring initially to FIG. 1, an expandable production tubing string of the present invention is being installed from an offshore oil and gas platform that is schematically illustrated and generally designated 10. A semi-submersible platform 12 is centered over a submerged oil and gas formation 14 located below sea floor 16. A subsea conduit 18 extends from deck 20 of platform 12 to wellhead installation 22 including subsea blow-out preventers 24. Platform 12 has a hoisting apparatus 26 and a derrick 28 for raising and lowering pipe strings such as expandable production tubing string 30.

A wellbore 32 extends through the various earth strata including formation 14. A casing 34 is cemented within wellbore 32 by cement 36. Expandable production tubing string 30 is coupled on its lower end to various tools including sand control screen assemblies 38, 40, 42 positioned adjacent to formation 14 between packers 44, 46 which define production interval 48 including perforations 50.

As explained in greater detail below, it may be desirable to expand the flow area within expandable production tubing string 30 to reduce to pressure drop in fluids being produced therethrough. Accordingly, expandable production tubing string 30 of the present invention includes a launcher 52 and a catcher 54 between which an expander member 56 longitudinally travels to plastically deform expandable production tubing string 30. In the illustrated embodiment, this is achieved by pressurizing expandable production tubing string 30 between a plug 58 and the lower end of expander member 56 by pumping fluid down through a work string such as a jointed tubing string or, as illustrated, a coiled tubing string 60 that is coupled to expander member 56.

Figure 2:
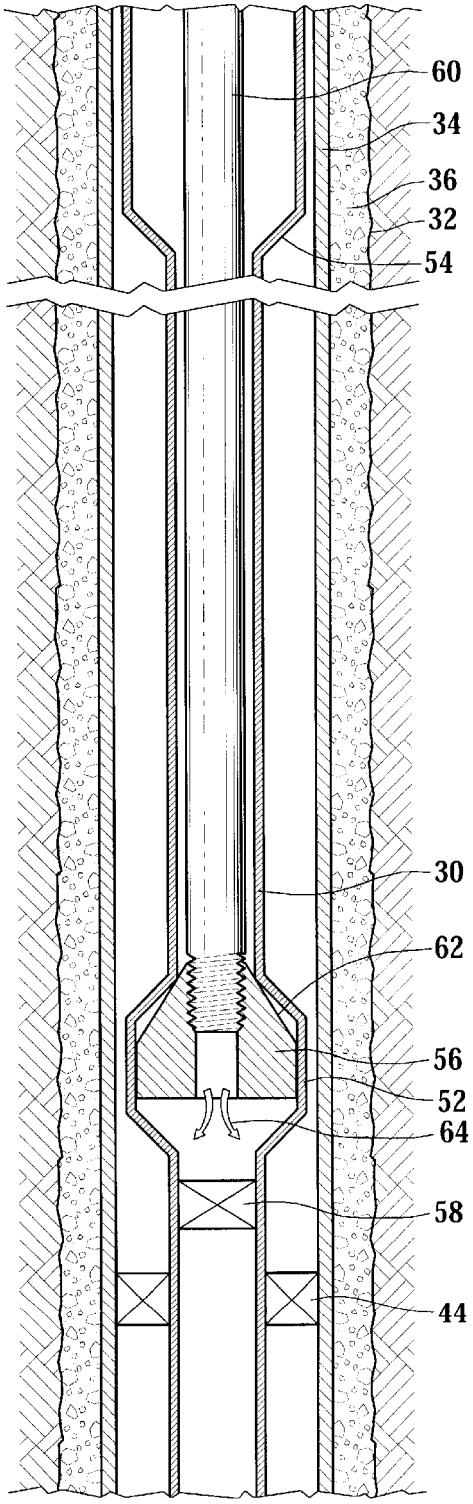
FIG. 2 is a half sectional view of an expandable production tubing string according to the present invention that is installed within a casing string prior to expansion.
Figure 3:
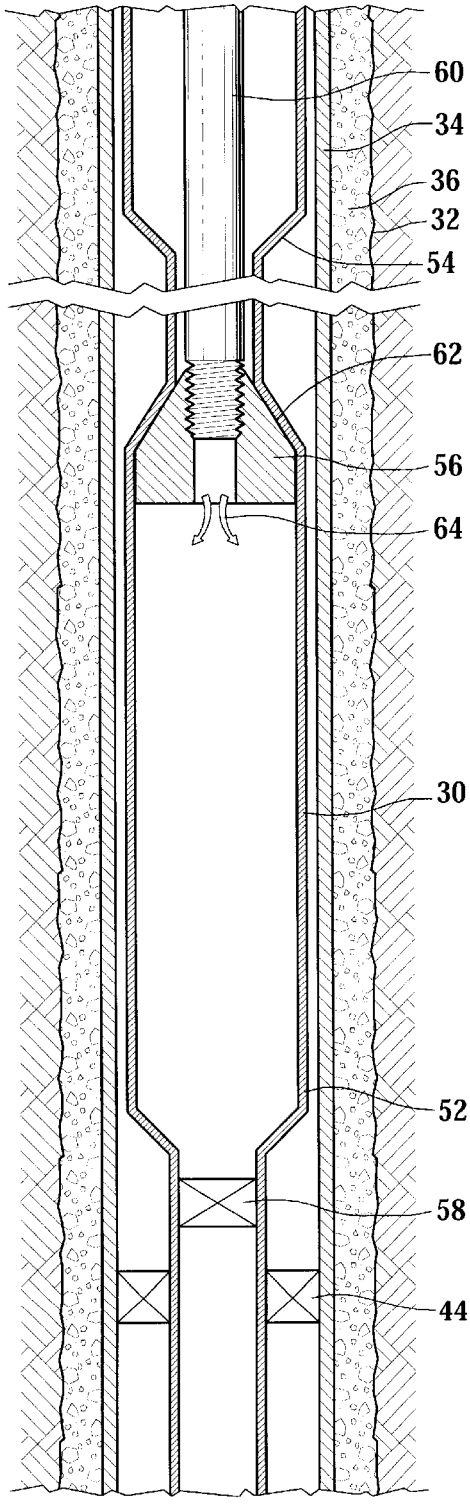
FIG. 3 is a half sectional view of an expandable production tubing string according to the present invention that is installed within a casing string after expansion.

Referring now to FIGS. 2 and 3, therein are depicted more detailed views of one method for expanding the flow area within expandable production tubing string 30. As described above, expandable production tubing string 30 is disposed within wellbore 32 having casing 34 cemented therein with cement 36. Packer 44 provides a fluid seal between expandable production tubing string 30 and casing string 34. Expandable production tubing string 30 includes launcher 52 and catcher 54. Initially disposed within launcher 52 is expander member 56.

It should be noted, however, by those skilled in the art that instead of installing expandable production tubing string 30 in casing string 34 with expander member 56 already positioned within launcher 52, an expander member could alternatively be run in after expandable production tubing string 30 has been installed within casing string 34. In this case, it may be necessary that the expander member have a smaller diameter configuration such that it may be run in expandable production tubing string 30 prior to expansion and a larger diameter configuration suitable for expanding expandable production tubing string 30 as described below. In fact, use of such expander members that have run in and expansion configurations may be preferred in situations wherein the decision to expand the production tubing is dependent upon testing of the productive capability of the formation traversed by the wellbore to determine whether production from the formation will be constrained by the production tubing. When such testing is performed and it is determined that the performance of the well would be enhanced by expanding the flow area of the production tubing, then the expander member may be placed in the production tubing to perform the expansion process.

In the illustrated embodiment, expander member 56 includes a tapered cone section 62 which includes a receiver portion that is coupled to the lower end of coiled tubing string 60. Disposed below launcher 52 within expandable production tubing string 30 is plug 58. The flow area within expandable production tubing string 30 is increased by moving expander member 56 longitudinally through expandable production tubing string 30 from launcher 52 to catcher 54. In the illustrated embodiment, a fluid is pumped down coiled tubing string 60 into the portion of expandable production tubing string 30 between plug 58 and the lower end of expander member 56, as indicated by arrows 64. The fluid pressure urges expander member 56 upwardly such that tapered cone section 62 of expander member 56 contacts the interior wall of expandable production tubing string 30. As the fluid pressure increases, tapered cone section 62 applies a radially outward force to the wall of expandable production tubing string 30. When this force is sufficient to plastically deform expandable production tubing string 30, expander member 56 begins to travel longitudinally within expandable production tubing string 30.

As the upward movement of expander member 56 progresses, expandable production tubing string 30 substantially uniformly expands from its original diameter to a diameter slightly larger that the diameter of expander member 56. It should be noted by those skilled in the art that the force necessary to plastically deform expandable production tubing string 30 is dependant upon a variety of factors including the ramp angle of tapered cone section 62, the amount of the desired expansion of expandable production tubing string 30, the material of expandable production tubing string 30 and the like. Also, it should be understood by those skilled in the art that since the increase in the flow area within expandable production tubing string 30 is proportional to the square of the increase in the diameter, large increases in the flow area of expandable production tubing string 30 are possible with rather small increases in diameter.

For example, if expandable production tubing string 30 has an original diameter of 3½-inches and an expanded diameter of 4½-inches, the diameter is increased by 28.6 percent while the flow area is increased by 65.3 percent. Using conventional carbon steel as the material for expandable production tubing string 30 the increase in the flow area may be between about 20 percent and 50 percent. Increases of more than 50 percent are also achievable depending upon the ductility of the material selected for expandable production tubing string 30.

Figure 4:
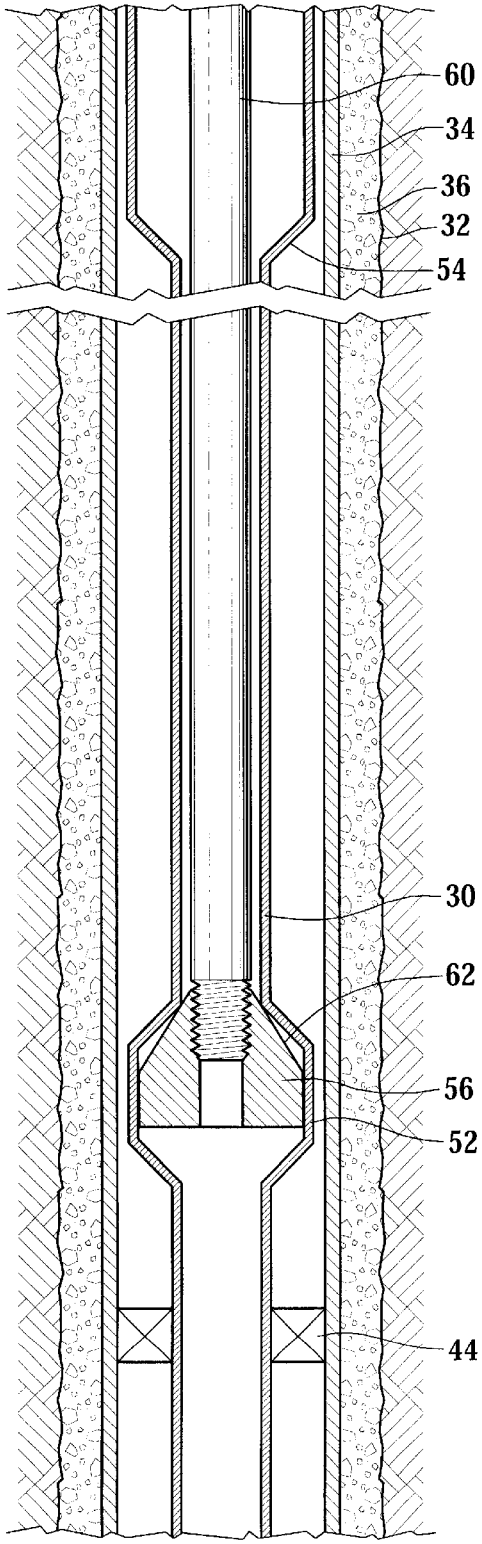
FIG. 4 is a half sectional view of an expandable production tubing string according to the present invention that is installed within a casing string prior to expansion.
Figure 5:
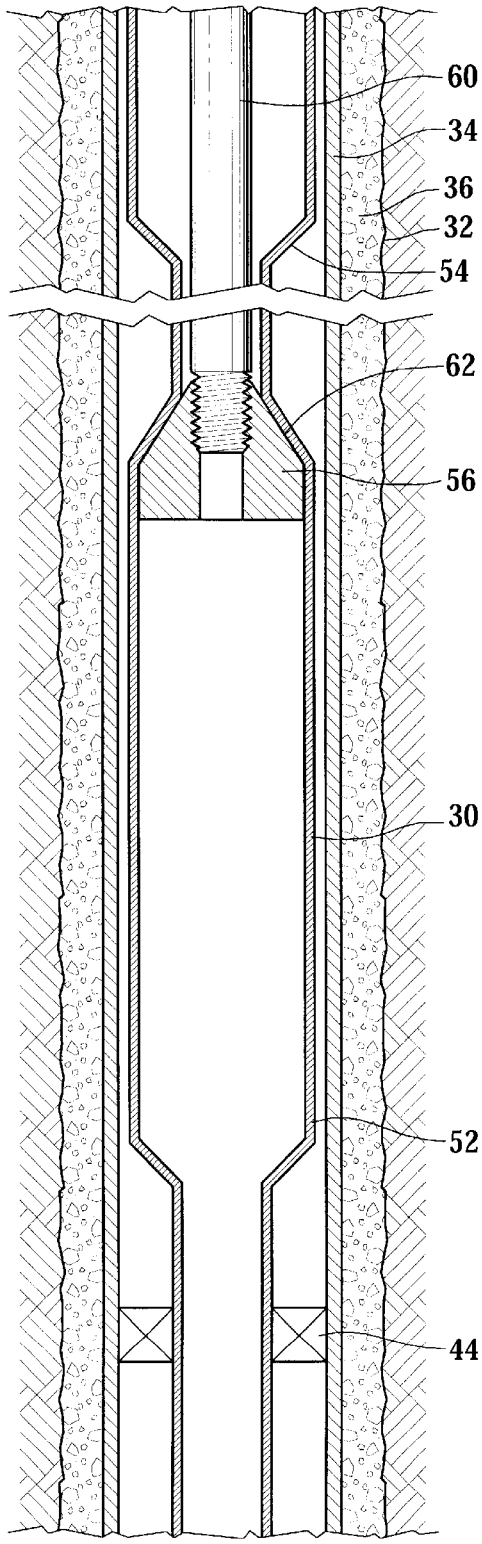
FIG. 5 is a half sectional view of an expandable production tubing string according to the present invention that is installed within a casing string after expansion.

As best seen in FIG. 3, since only a short section of expandable production tubing string 30 is being expanded at any one time, the fluid pumped through coiled tubing string 60 typically provides sufficient upward force to expander member 56 to expand that section of expandable production tubing string 30. This force may be controlled by adjusting the flow rate and pressure at which the fluid is delivered through coiled tubing string 60. In addition, the upward force of expander member 56 may be enhanced by pulling on expander member 56 which may be accomplished by placing coiled tubing string 60 in tension. In fact, as best seen in FIGS. 4 and 5, longitudinal movement of expander member 56 may be achieved completely mechanically by pulling expander member 56 through expandable production tubing string 30 by placing coiled tubing string 60 in sufficient tension. In this case, since no fluids are used to upwardly urge expander member 56, no plug below catcher 52 is necessary.

It should be apparent to those skilled in the art that the use of direction terms such as above, below, upper, lower, upward, downward and the like are used in relation to the illustrated embodiments as they are depicted in the figures, the upward direction being toward the top of the corresponding figure and the downward being toward the bottom of the corresponding figure. Accordingly, it should be noted that the expandable production tubing string of the present invention and the methods for expanding the flow area within the expandable production tubing string of the present invention are not limited to the vertical orientation as they are equally well suited for use in inclined, deviated and horizontal wellbores.

Figure 6:
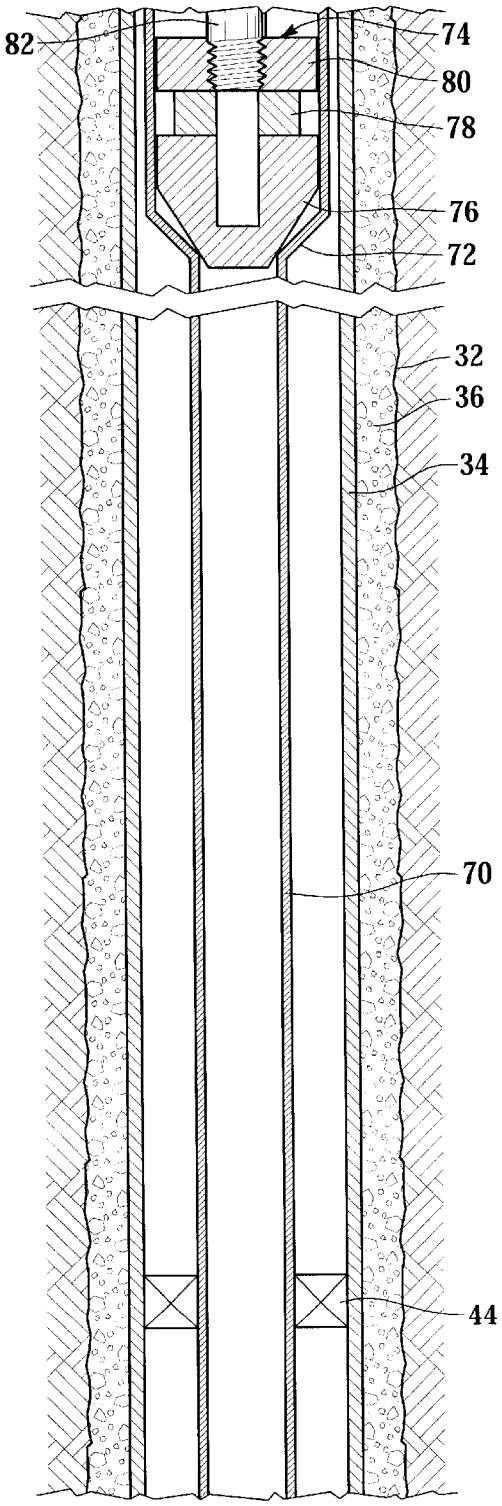
FIG. 6 is a half sectional view of an expandable production tubing string according to the present invention that is installed within a casing string prior to expansion.
Figure 7:
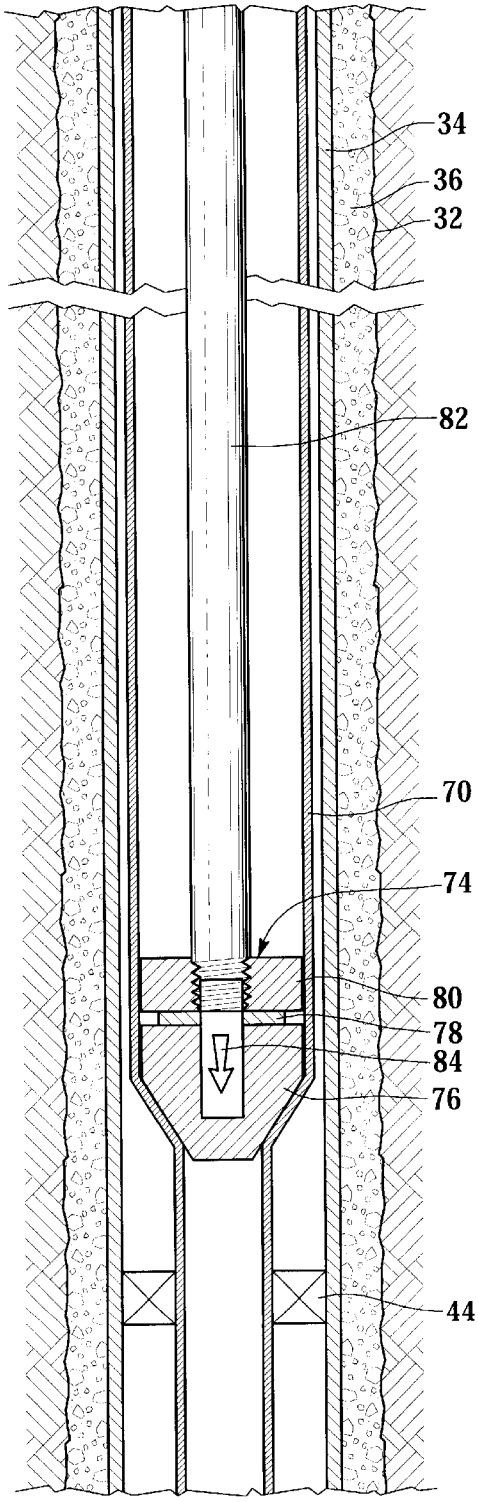
FIG. 7 is a half sectional view of an expandable production tubing string according to the present invention that is installed within a casing string after expansion.

While FIGS. 1–5 have depicted the expansion of expandable production tubing 30 as progressing from a downhole location to an uphole location, the expansion could alternatively progress from an uphole location to a downhole location, as best seen in FIGS. 6 and 7. Specifically, expandable production tubing string 70 is disposed within wellbore 32 having casing string 34 cemented therein with cement 36. Expandable production tubing string 70 includes a launcher 72 into which an expander member 74 is placed. Expander member 74 includes a tapered cone section 76, a piston 78 and an anchor section 80. Anchor section 80 includes a receiver portion that is coupled to the lower end of coiled tubing string 82.

In operation, a downward force is applied on expander member 74 by applying the weight of coiled tubing string 82 on expander member 74. This downward force operates to stroke piston 78 to its compressed position, as best seen in FIG. 7. Once piston 78 completes its downward stroke, fluid is pumped down coiled tubing string 82 which sets anchor section 80 creating a friction grip between anchor section 80 and the interior of expandable production tubing string 70 which prevents upward movement of anchor section 80. As more fluid is pumped down coiled tubing string 82 into the interior of expander member 74, as indicated by arrow 84, the fluid pressure urges tapered cone section 76 downwardly such that tapered cone section 76 places a radially outward force against the wall of expandable production tubing string 70 causing expandable production tubing string 70 to plastically deform. This process continues in a step wise fashion wherein each stroke of expander member 74 expands a section of expandable production tubing string 70. After the desired length of expandable production tubing string 70 has been expanded, coiled tubing string 82 and expander member 74 may be retrieved to the surface.

Figure 8A:
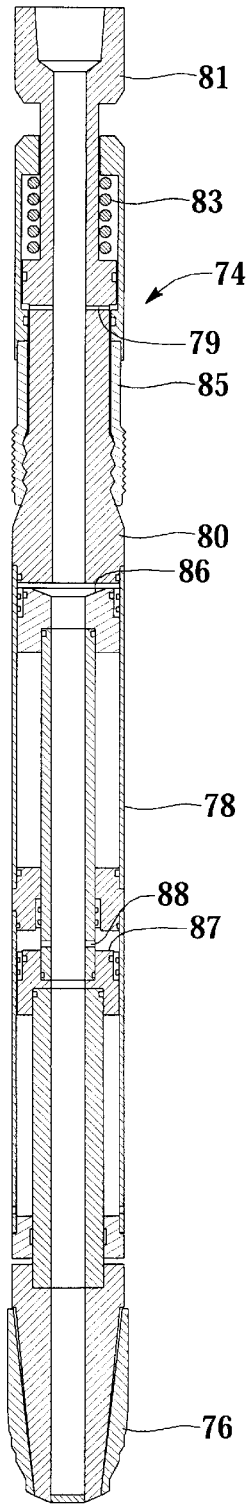
FIGS. 8A–8B are a half sectional views of an expander member for use in expanding the expandable production tubing string according to the present invention in its contacted and expanded positions, respectively.
Figure 8B:
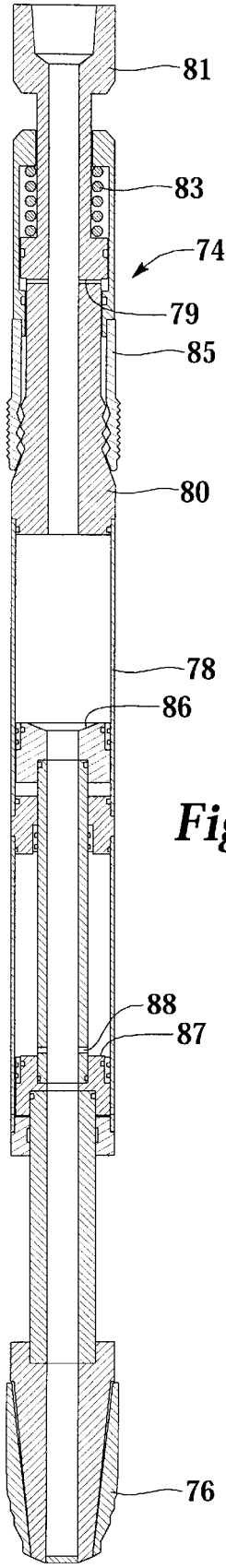

Referring now to FIGS. 8A–8B, therein are depicted more detailed views of expander member 74 in its fully contracted and fully extended positions, respectively. Expander member 74 includes a tapered cone section 76, a piston 78 and an anchor section 80. Anchor section 80 includes a receiver portion 81 that may be coupled to the lower end of coiled tubing string 82 (not pictured). Anchor section 80 includes fluid ports 79, coiled spring 83 and slips 85 that cooperate together such that when a fluid pressure is applied within expander member 74 and into fluid ports 79, coiled spring 83 is compressed causing slips 85 to outwardly radially expand and grip the interior of expandable production tubing string 70 (not pictured). In addition, the fluid pressure acts on piston 78 on surface 86 and surface 87, via fluid ports 88, such that the force of the fluid pressure is multiplied. This force acting on piston 78 causes piston 78, along with tapered cone section 76, to be downwardly urged toward the position depicted in FIG. 8B. Once expander member 74 has completed its stroke and expanded a length of expandable production tubing string 70 (not pictured), the fluid pressure in expander member 74 is allowed to bleed off such that expander member 74 may be collapsed back to the configuration depicted in FIG. 8A and another stoke of expander member 74 may begin.

Figure 9:
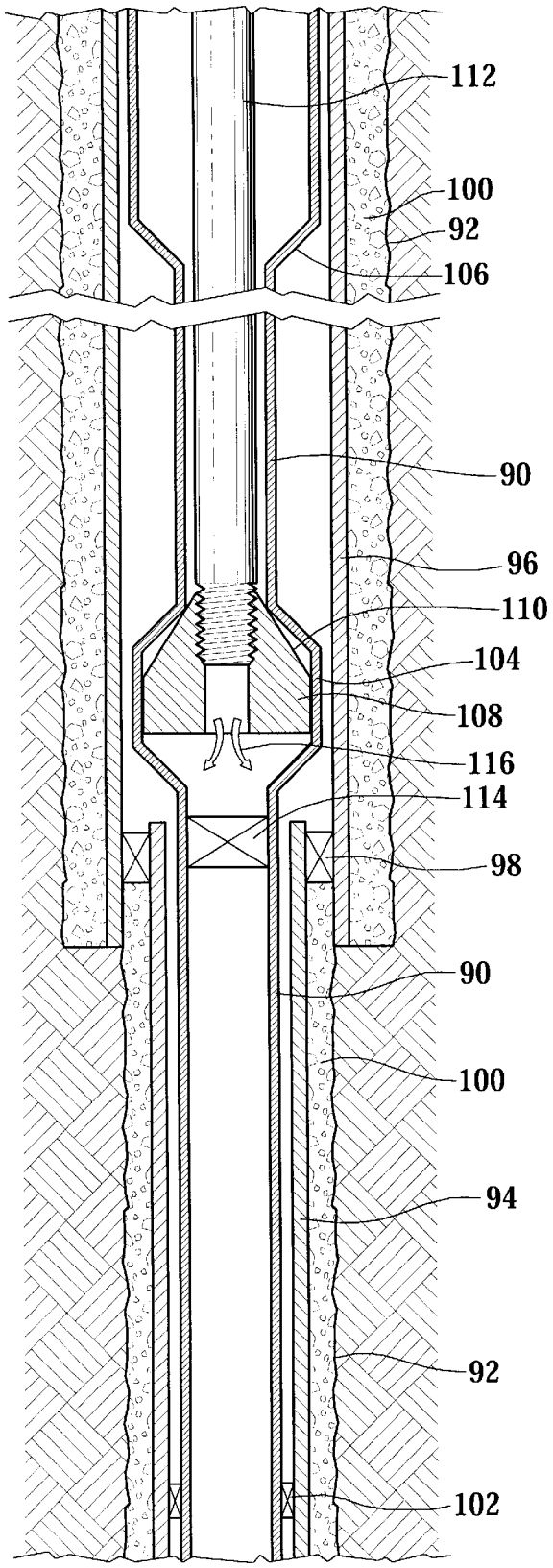
FIG. 9 is a half sectional view of an expandable production tubing string according to the present invention that is installed within a casing string and a liner string prior to expansion.

Referring now to FIG. 9, therein is depicted another embodiment of a method for expanding the flow area within an expandable production tubing string that is designated 90. Expandable production tubing string 90 is disposed within wellbore 92 having a production casing string liner 94 suspended from an intermediate casing string 96 on a liner hanger 98. Both production casing string liner 94 and intermediate casing string 96 are cemented within wellbore 92 with cement 100. Packer 102 provides a fluid seal between expandable production tubing string 90 and production casing string liner 94. Expandable production tubing string 90 includes launcher 104 and catcher 106. Initially disposed within launcher 104 is expander member 108.

Expander member 108 includes a tapered cone section 110 which includes a receiver portion that is coupled to the lower end of coiled tubing string 112. Disposed below launcher 104 within expandable production tubing string 90 is plug 114. In the illustrated embodiment, it is desired to reduce to pressure drop in the fluids being produced through expandable production tubing string 90, however, the clearance between expandable production tubing string 90 and production casing string liner 94 is not sufficient for the desired expansion of expandable production tubing string 90. It is nonetheless desirable to expand the flow area within expandable production tubing string 90 above production casing string liner 94 as this expansion will decrease the pressure drop from that point to the surface. Accordingly, by moving expander member 108 longitudinally through expandable production tubing string 90 from launcher 104 to catcher 106, the pressure drop within expandable production tubing string 90 is reduced.

While a variety of methods may be used to expand the flow area of expandable production tubing string 90, in the illustrated embodiment, a fluid is pumped down coiled tubing string 112 into the portion of expandable production tubing string 90 between plug 114 and the lower end of expander member 108 as indicated by arrows 116. The fluid pressure urges expander member 108 upwardly such that tapered cone section 110 of expander member 108 contacts the interior wall of expandable production tubing string 90 applying a radially outward force thereto which plastically deforms expandable production tubing string 90 as expander member 108 travels longitudinally within expandable production tubing string 90. The plastic deformation of expandable production tubing string 90 results in substantially uniform expansion of expandable production tubing string 90 from its original diameter to a diameter slightly larger that the diameter of expander member 108.

Figure 10:
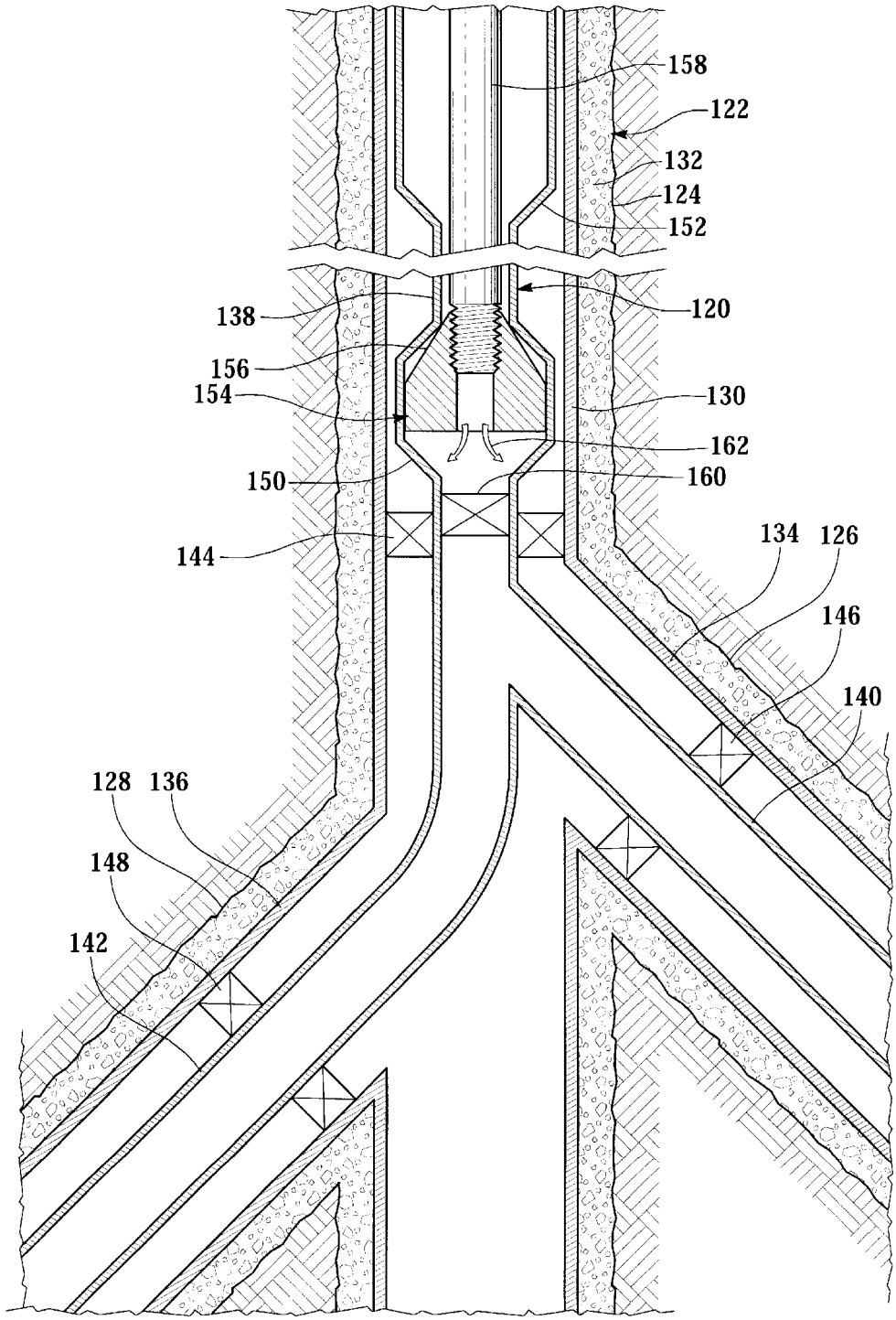
FIG. 10 is a half sectional view of an expandable production tubing string according to the present invention that is installed within a casing string of a multilateral wellbore prior to expansion.

Referring now to FIG. 10, therein is depicted another embodiment of a method for expanding the flow area within an expandable production tubing string that is designated 120. Expandable production tubing string 120 is disposed within a multilateral wellbore 122. In the illustrated embodiment, multilateral wellbore 122 has a main wellbore 124 and two branch wellbores 126, 128. A main wellbore casing string 130 is cemented within main wellbore 124 by cement 132. Likewise, branch wellbore casing strings 134, 136 are respectively cemented within branch wellbores 126, 128.

Expandable production tubing string 120 includes a main wellbore production tubing string 138 and two branch wellbore production tubing strings 140, 142. Packer 144 provides a fluid seal between main wellbore production tubing string 138 and main wellbore casing string 130. Packer 146 provides a fluid seal between branch wellbore production tubing string 140 and branch wellbore casing string 134. Packer 148 provides a fluid seal between branch wellbore production tubing string 142 and branch wellbore casing string 136.

Expandable production tubing string 120 includes launcher 150 and catcher 152. Initially disposed within launcher 150 is expander member 154. Expander member 154 includes a tapered cone section 156 which includes a receiver portion that is coupled to the lower end of coiled tubing string 158. Disposed below launcher 150 within expandable production tubing string 120 is plug 160.

In the illustrated embodiment, when the production stream from branch wellbore production tubing string 140 enters main wellbore production tubing string 138 and is commingled with the production stream originating from branch wellbore production tubing string 142, the combined flow may be restricted by the size of expandable production tubing string 120. Accordingly, it may be desirable to increase the flow area of expandable production tubing string 120 from a location proximate, either uphole or downhole, of the depth at which the additional production fluids are introduced into main wellbore production tubing string 138. In the illustrated embodiment, this is achieved by moving expander member 154 longitudinally through expandable production tubing string 120 from launcher 150 located uphole of branch wellbore production tubing string 140 to catcher 152.

While a variety of methods may be used to expand the flow area of expandable production tubing string 120, in the illustrated embodiment, a fluid is pumped down coiled tubing string 158 into the portion of expandable production tubing string 120 between plug 160 and the lower end of expander member 154 as indicated by arrow 162. The fluid pressure urges expander member 154 upwardly such that tapered cone section 156 of expander member 154 contacts the interior wall of expandable production tubing string 120 applying a radially outward force thereto which plastically deforms expandable production tubing string 120 as expander member 154 travels longitudinally within expandable production tubing string 120. The plastic deformation of expandable production tubing string 120 results in substantially uniform expansion of expandable production tubing string 120 from its original diameter to a diameter slightly larger that the diameter of expander member 154.

In a multilateral embodiment as depicted in FIG. 10, it may be desirable to match the flow area of expandable production tubing string 120 to the sum of the flow areas of branch wellbore production tubing strings 140, 142. Likewise in multilateral wellbores having more than two branches from which production fluids are commingled, the production tubing expansion techniques as described herein may be used to match the flow area in the main wellbore sections of the production tubing to the sum of the flow areas of the branch wellbore production tubing strings uphole thereof.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A method for reducing the pressure drop in fluids produced through a production tubing from a downhole formation traversed by a wellbore, the method comprising the steps of:

lining the wellbore with a well casing;

disposing the production tubing within the well casing; and expanding the production tubing downhole, thereby reducing the pressure drop in fluids produced through the production tubing and increasing production.

2. The method as recited in claim 1 wherein the step of expanding the production tubing downhole further comprises expanding the production tubing from an uphole location to a downhole location.

3. The method as recited in claim 1 wherein the step of expanding the production tubing downhole further comprises expanding the production tubing from a downhole location to an uphole location.

4. The method as recited in claim 1 wherein the step of expanding the production tubing downhole further comprises placing an expander member within the production tubing and pressurizing at least a portion of the production tubing to urge the expander member to travel longitudinally within the production tubing, thereby expanding the production tubing.

5. The method as recited in claim 1 further comprising placing an expander member within the production tubing and coupling a coiled tubing to the expander member.

6. The method as recited in claim 5 wherein the step of expanding the production tubing downhole further comprises pressurizing the coiled tubing and at least a portion of the production tubing to urge the expander member to travel longitudinally within the production tubing, thereby expanding the production tubing.

7. The method as recited in claim 5 wherein the step of expanding the production tubing downhole further comprises pulling the coiled tubing to urge the expander member to travel longitudinally within the production tubing, thereby expanding the production tubing.

8. The method as recited in claim 5 wherein the step of expanding the production tubing downhole further comprises pressurizing the coiled tubing and at least a portion of the production tubing and pulling the coiled tubing to urge the expander member to travel longitudinally within the production tubing, thereby expanding the production tubing.

9. The method as recited in claim 5 wherein the step of expanding the production tubing downhole further comprises the step of stoking the expander member by pressurizing the coiled tubing and an interior section of the expander member to urge at least a portion of the expander member to travel longitudinally within the production tubing, thereby expanding the production tubing.

10. The method as recited an claim 1 wherein the step of expanding the production tubing downhole further comprises expanding the flow area of the production tubing between about 20 percent and 50 percent.

11. The method as recited in claim 1 wherein the step of expanding the production tubing downhole further comprises expanding the flow area of the production tubing more than 50 percent.

12. A method for reducing the pressure drop in fluids produced through a production tubing from a downhole formation traversed by a wellbore, the method comprising the steps of:

lining a first section of the wellbore with a first well casing having an inner diameter;

lining a second section of the wellbore with a second well casing having an inner diameter that is smaller than the inner diameter of the first well casing;

disposing the production tubing within the first and the second well casings; and expanding the production tubing downhole that is disposed within the first well casing.

13. The method as recited in claim 12 wherein the step of expanding the production tubing downhole that is disposed within the first well casing further comprises expanding from an uphole location to a downhole location.

14. The method as recited in claim 12 wherein the step of expanding the production tubing downhole that is disposed within the first well casing further comprises expanding from a downhole location to an uphole location.

15. The method as recited in claim 12 wherein the step of expanding the production tubing downhole that is disposed within the first well casing further comprises placing an expander member within the production tubing and pressurizing at least a portion of the production tubing to urge the expander member to travel longitudinally within the production tubing, thereby expanding the production tubing.

16. The method as recited in claim 12 further comprising placing an expander member within the production tubing and coupling a coiled tubing to the expander member.

17. The method as recited in claim 16 wherein the step of expanding the production tubing downhole that is disposed within the first well casing further comprises pressurizing the coiled tubing and at least a portion of the production tubing to urge the expander member to travel longitudinally within the production tubing, thereby expanding the production tubing.

18. The method as recited in claim 16 wherein the step of expanding the production tubing downhole that is disposed within the first well casing further comprises pulling the coiled tubing to urge the expander member to travel longitudinally within the production tubing, thereby expanding the production tubing.

19. The method as recited in claim 16 wherein the step of expanding the production tubing downhole that is disposed within the first well casing further comprises pressurizing the coiled tubing and at least a portion of the production tubing and pulling the coiled tubing to urge the expander member to travel longitudinally within the production tubing, thereby expanding the production tubing.

20. The method as recited in claim 16 wherein the step of expanding the production tubing downhole that is disposed within the first well casing further comprises the step of stoking the expander member by pressurizing the coiled tubing and an interior section of the expander member to urge at least a portion of the expander member to travel longitudinally within the production tubing, thereby expanding the production tubing.

21. The method as recited in claim 12 wherein the step of expanding the production tubing downhole that is disposed within the first well casing further comprises expanding the flow area of the production tubing that is disposed within the first well casing between about 20 percent and 50 percent.

22. The method as recited in claim 12 wherein the step of expanding the production tubing downhole that is disposed within the first well casing further comprises expanding the flow area of the production tubing that is disposed within the first well casing more than 50 percent.

23. A method for reducing the pressure drop in fluids produced through a main section of production tubing disposed in a multilateral well, the method comprising the steps of:

lining at least a main wellbore portion of the multilateral well with a well casing;

extending first and second branch wellbores from the main wellbore, the second branch wellbore being farther downhole than the first branch wellbore;

disposing the main section of production tubing within the well casing in the main wellbore, a first branch section of production tubing within the first branch wellbore and a second branch section of production tubing within the second branch wellbore; and expanding the production tubing downhole that is uphole of the first branch wellbore.

24. The method as recited in claim 23 wherein the step of expanding the production tubing downhole that is uphole of the first branch wellbore further comprises expanding from an uphole location to a downhole location.

25. The method as recited in claim 23 wherein the step of expanding the production tubing downhole that is uphole of the first branch wellbore comprises expanding from a downhole location to an uphole location.

26. The method as recited in claim 23 wherein the step of expanding the production tubing downhole that is uphole of the first branch wellbore further comprises placing an expander member within the production tubing and pressurizing at least a portion of the production tubing to urge the expander member to travel longitudinally within the production tubing, thereby expanding the production tubing.

27. The method as recited in claim 23 further comprising placing an expander member within the production tubing and coupling a coiled tubing to the expander member.

28. The method as recited in claim 27 wherein the step of expanding the production tubing downhole that is uphole of the first branch wellbore further comprises pressurizing the coiled tubing and at least a portion of the production tubing to urge the expander member to travel longitudinally within the production tubing, thereby expanding the production tubing.

29. The method as recited in claim 27 wherein the step of expanding the production tubing downhole that as uphole of the first branch wellbore further comprises pulling the coiled tubing to urge the expander member to travel longitudinally within the production tubing, thereby expanding the production tubing.

30. The method as recited in claim 27 wherein the step of expanding the production tubing downhole that is uphole of the first branch wellbore further comprises pressurizing the coiled tubing and at least a portion of the production tubing and pulling the coiled tubing to urge the expander member to travel longitudinally within the production tubing, thereby expanding the production tubing.

31. The method as recited in claim 27 wherein the step of expanding the production tubing downhole that is uphole of the first branch wellbore further comprises the step of stoking the expander member by pressurizing the coiled tubing and an interior section of the expander member to urge at least a portion of the expander member to travel longitudinally within the production tubing, thereby expanding the production tubing.

32. The method as recited in claim 23 wherein the step of expanding the production tubing downhole that is uphole of the first branch wellbore further comprises expanding the flow area of the production tubing that is uphole of the first branch wellbore between about 20 percent and 50 percent.

33. The method as recited in claim 23 wherein the step of expanding the production tubing downhole that is uphole of the first branch wellbore further comprises expanding the flow area of the production tubing that is uphole of the first branch wellbore more than 50 percent.

34. The method as recited in claim 23 wherein the step of expanding the production tubing downhole that is uphole of the first branch wellbore further comprises expanding the flow area of the production tubing that is uphole of the first branch wellbore to substantially match the flow area of the first branch section of production tubing and the flow area of the second branch section of production tubing.

35. A method for optimizing production from a downhole formation traversed by a wellbore, the method comprising the steps of:

lining the wellbore with a well casing;

disposing a production tubing within the well casing;

testing the productive capability of the formation to determine whether production from the formation is constrained by the production tubing; and expanding the production tubing downhole if the production from the formation is constrained by the production tubing to increase production.

36. The method as recited in claim 35 wherein the step of expanding the production tubing downhole further comprises expanding the production tubing from an uphole location to a downhole location.

37. The method as recited in claim 35 wherein the step of expanding the production tubing downhole further comprises expanding the production tubing from a downhole location to an uphole location.

38. The method as recited in claim 35 wherein the step of expanding the production tubing downhole further comprises placing an expander member within the production tubing and pressurizing at least a portion of the production tubing to urge the expander member to travel longitudinally within the production tubing, thereby expanding the production tubing.

39. The method as recited in claim 35 further comprising placing an expander member within the production tubing and coupling a coiled tubing to the expander member.

40. The method as recited in claim 39 wherein the step of expanding the production tubing downhole further comprises pressurizing the coiled tubing and at least a portion of the production tubing to urge the expander member to travel longitudinally within the production tubing, thereby expanding the production tubing.

41. The method as recited in claim 39 wherein the step of expanding the production tubing downhole further comprises pulling the coiled tubing to urge the expander member to travel longitudinally within the production tubing, thereby expanding the production tubing.

42. The method as recited in claim 39 wherein the step of expanding the production tubing downhole further comprises pressurizing the coiled tubing and at least a portion of the production tubing and pulling the coiled tubing to urge the expander member to travel longitudinally within the production tubing, thereby expanding the production tubing.

43. The method as recited in claim 39 wherein the step of expanding the production tubing downhole further comprises the step of stoking the expander member by pressurizing the coiled tubing and an interior section of the expander member to urge at least a portion of the expander member to travel longitudinally within the production tubing, thereby expanding the production tubing.

44. The method as recited in claim 35 wherein the step of expanding the production tubing downhole further comprises expanding the flow area of the production tubing between about 20 percent and 50 percent.

45. The method as recited in claim 35 wherein the step of expanding the production tubing downhole further comprises expanding the flow area of the production tubing more than 50 percent.

46. A well completion system for reducing the pressure drop in fluids produced therethrough from a downhole formation traversed by a wellbore, the system comprising:

a production tubing that is positioned within a well casing lining the wellbore; and an expander member positioned within the production tubing that travels longitudinally within the production tubing to expand the production tubing downhole, thereby reducing the pressure drop in fluids produced through the production tubing and increasing production.

47. The system as recited in claim 46 wherein the expander member travels longitudinally within the production tubing from an uphole location to a downhole location.

48. The system as recited in claim 46 wherein the expander member travels longitudinally within the production tubing from a downhole location to an uphole location.

49. The system as recited in claim 46 wherein the expander member is urged to travel longitudinally within the production tubing by pressurizing at least a portion of the production tubing.

50. The system as recited in claim 46 further comprising a coiled tubing coupled to the expander member.

51. The system as recited in claim 50 wherein the expander member is urged to travel longitudinally within the production tubing by pressurizing the coiled tubing and at least a portion of the production tubing.

52. The system as recited in claim 50 wherein the expander member is urged to travel longitudinally within the production tubing by pulling the coiled tubing.

53. The system as recited in claim 50 wherein the expander member is urged to travel longitudinally within the production tubing by pressurizing the coiled tubing and at least a portion of the production tubing and pulling the coiled tubing.

54. The system as recited in claim 50 wherein the expander member is urged to travel longitudinally within the production tubing by pressurizing the coiled tubing and an interior section of the expander member to urge at least a portion of the expander member to travel longitudinally within the production tubing, thereby expanding the production tubing.

55. The system as recited in claim 46 wherein the flow area of the production tubing is expanded between about 20 percent and 50 percent.

56. The system as recited in claim 46 wherein the flow area of the production tubing is expanded more than 50 percent.

* * * * *